US005335137A

United States Patent [19]

English et al.

[11] Patent Number: 5,335,137

[45] Date of Patent: Aug. 2, 1994

[54] COMPUTER KEYBOARD WITH ELECTROSTATIC DISCHARGE FEATURE

[75] Inventors: George P. English, Coeur d'Alene, Id.; Nathan Batson, Newman Lake, Wash.

[73] Assignee: Key Tronic Corporation, Spokane, Wash.

[21] Appl. No.: 921,514

[22] Filed: Jul. 29, 1992

[51] Int. Cl.[5] ..... H05F 3/04

[52] U.S. Cl. ..... 361/220; 174/5 SG; 200/305; 361/212

[58] Field of Search ..... 361/212, 220; 307/326; 200/305, 304; 174/5 R, 5 SG

[56] References Cited

U.S. PATENT DOCUMENTS

| | | | |
|---|---|---|---|
| 3,621,164 | 11/1971 | Backer | 200/61.58 R |
| 4,040,120 | 8/1977 | Geadah et al. | 361/220 |
| 4,303,960 | 12/1981 | Sherwood et al. | 361/212 |
| 4,456,800 | 6/1984 | Holland | 200/5 A |
| 4,586,106 | 4/1986 | Frazier | 361/212 |
| 4,633,364 | 12/1986 | Nakamura et al. | 361/216 |
| 4,654,746 | 3/1987 | Lewis, Jr. et al. | 361/212 |
| 4,737,883 | 4/1988 | Hausler | 361/220 |
| 4,809,126 | 2/1989 | Burkman et al. | 361/212 |
| 4,821,320 | 4/1989 | Andert et al. | 361/212 |
| 5,063,474 | 11/1991 | Igarashi | 361/220 |
| 5,117,076 | 5/1992 | Damitio | 200/344 |

FOREIGN PATENT DOCUMENTS

| | | |
|---|---|---|
| 3617734 | 3/1987 | Fed. Rep. of Germany . |
| WO87/07997 | 6/1987 | PCT Int'l Appl. . |

OTHER PUBLICATIONS

"Method for providing Electrostatic Discharge on Keyboards", 2244 Research Disclosure May, (1990) No. 313, Emsworth, GB p. 414.

"Discharging the Electrostatic Potential of a Keyboard Operator Through the Spacebar", IBM Technical Disclosure Bulletin, vol. 32 No. 1, Jun. 1989 pp. 78-79.

"Dials with Antistatic Feature", IBM Tech. Dicl. Bulletin, vol. 32, No. 12 May 1990 pp. 371-372.

*Primary Examiner*—Brian K. Young
*Assistant Examiner*—Richard T. Elms
*Attorney, Agent, or Firm*—Wells, St. John, Roberts, Gregory & Matkin

[57] ABSTRACT

A computer keyboard according to a preferred construction has multiple non-conductive keys and at least one conductive key mounted in a keyboard housing. The conductive key includes a molded plastic key body having conductive material embedded therein. Conductive plugs are electrically coupled and mounted to the conductive key body. An electrostatic discharge pad is provided on a switch assembly positioned beneath the keys of the keyboard. The discharge pad is coupled to ground through a path resistor. When the conductive key body is depressed to an activated position, the plugs engage the electrostatic discharge pads so that electrostatic charges of the user progressively dissipate to ground through the key body, plug, discharge pad, and path resistor. At least one of the path resistor or the plug has a resistance greater than the resistance of the conductive key body. In this manner, electrostatic charge is routinely dissipated from a computer user while insuring that the user is not shocked when he/she initially touches and operates the conductive key.

24 Claims, 2 Drawing Sheets

Fig 1
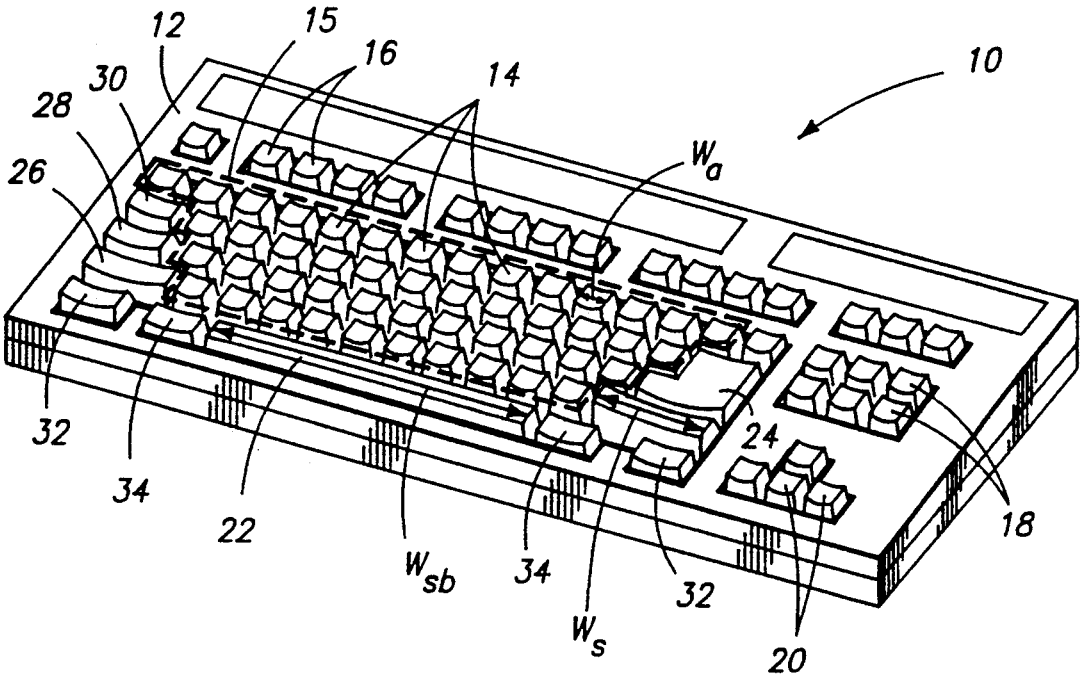
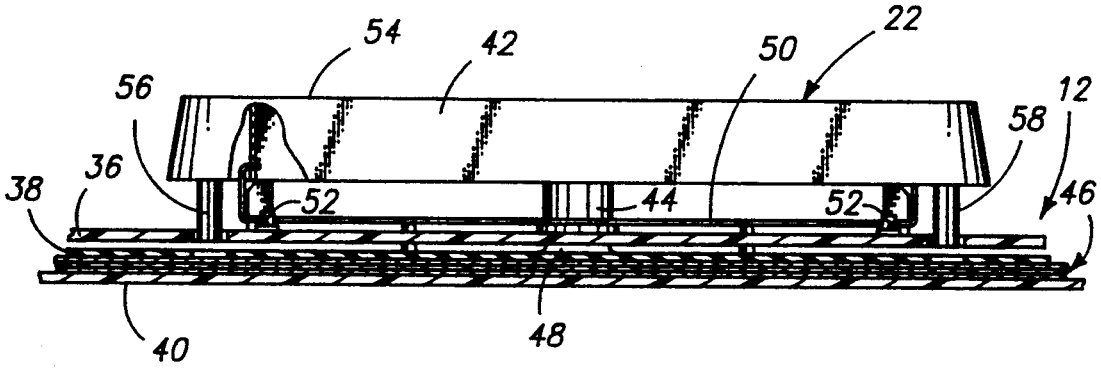
Fig 2

Fig 3
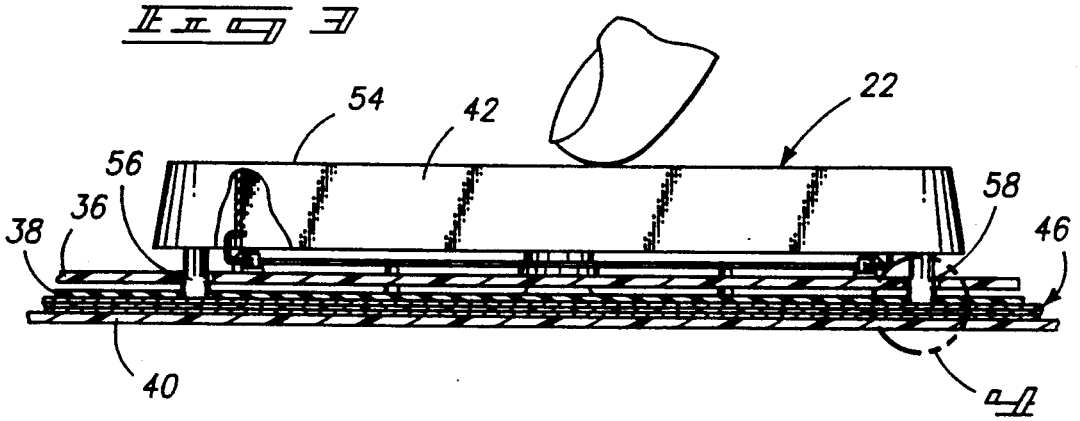
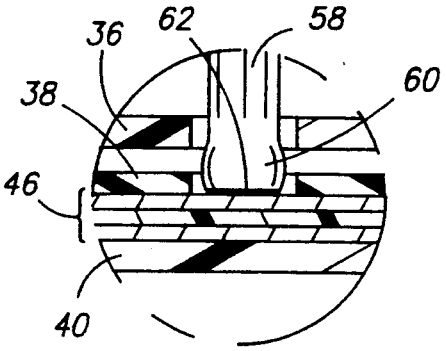
Fig 4
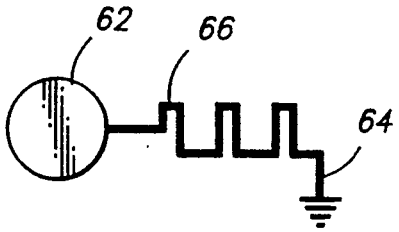
Fig 5
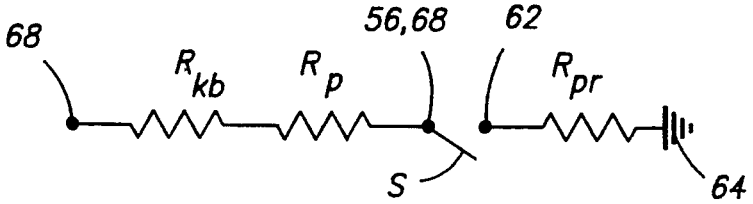
Fig 6

COMPUTER KEYBOARD WITH ELECTROSTATIC DISCHARGE FEATURE

TECHNICAL FIELD

This invention relates to keyboards and more particularly, to computer keyboards with an electrostatic discharge feature.

BACKGROUND OF THE INVENTION

In recent years, there has been increasing awareness of potential adverse health effects caused by prolonged use of computers. For instance, visual display monitors emit electromagnetic waves which cause a build up of electrostatic charge on a computer operator's body. This accumulated charge may adversely affect the operator's health. There is concern that those who work daily with visual display monitors may face an occupational health hazard due to the emissions of the electromagnetic waves from the display.

One technique for reducing computer-related health risks is to periodically remove accumulated electrostatic charge from the computer operator. U.S. Pat. No. 4,586,106 proposes the use of a static dissipative touch device which a computer operator touches prior to using a computer. The disclosed purpose for dissipating charge is to prevent damage to the electronic equipment caused by static discharge. This patent discloses positioning a long narrow touch pad on the front side of a computer keyboard apart from the keys. This touch pad is grounded. Prior to using the computer, the user is required to make contact with the touch pad so that any electrostatic charge may be dissipated to ground through this pad. In practice, the technique is cumbersome for it requires the user to consciously contact this touch pad prior to placing his/her hands on the keyboard keys. Additionally, this device provides only a one time static discharge prior to operation of the computer. The touch device described in the above-referenced patent fails to dissipate electrostatic charge on a routine basis.

This invention provides a convenient and effective technique for routinely dissipating electrostatic charge which accumulates on a computer user to reduce potential health risks associated with operating computers.

BRIEF DESCRIPTION OF THE DRAWINGS

One or more preferred embodiments is described with reference to the following accompanying drawings.

FIG. 1 is a top plan view of a computer keyboard in accordance with the invention.

FIG. 2 is a partial cross-sectional view of the FIG. 1 keyboard taken adjacent a "spacebar" key. FIG. 2 shows the "spacebar" key in an extended ready position.

FIG. 3 is a partial cross-sectional view similar to FIG. 2 and shows the "spacebar" key in a depressed activated position.

FIG. 4 is an enlarged cross-sectional view taken within circle 4 in FIG. 3.

FIG. 5 is a diagrammatical illustration of a touch pad and path resistor employed in the FIG. 1 keyboard.

FIG. 6 is a circuit representation of a keyboard having an electrostatic discharge device constructed according to the invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

FIG. 1 shows a computer keyboard 10 for inputting command or data signals into a processing device, such as a computer (not shown). Keyboard 10 has multiple keys mounted in a housing 12 and arranged in a conventional typewriter layout. Keyboard 10 includes "alphanumeric" keys 14 which are illustrated enclosed within dashed boundary line 15. Keyboard 10 further includes "function" keys 16 positioned in a linear row above alphanumeric keys 14, and "command" keys 18 and "cursor" keys 20 arranged at one end of housing 12. Keyboard 10 also includes a "spacebar" key 22, an "enter" key 24, two "shift" keys 26, a "cap lock" key 28, a "tab" key 30, two "control" keys 32, and two "alt" keys 34 arranged about the periphery of alphanumeric keys 14.

Alphanumeric keys 14, function keys 16, command keys 18, and cursor keys 20 all have a "single finger" width $W_a$. These keys are preferably electrically non-conductive and include key bodies which are moveable between an extended ready position and a depressed activated position.

Keyboard 10 has at least one electrically conductive key which is employed to dissipate electrostatic charge when a computer operator depresses the key. Preferably, the conductive key is a frequently used key so that accumulated electrostatic charge is dissipated on a routine basis. For example, frequently used keys which could be made electrically conductive include "spacebar" key 22, "enter" key 24, "shift" keys 26, "tab" key 30, "control" keys 32, and "alt" keys 34. Each of these keys has a longitudinal "multi-finger" width greater than the longitudinal width $W_a$ of non-conductive alphanumeric keys 14. For instance, spacebar key 22 has a multi-finger width $W_{sb}$ and shift key 26 has a multi-finger width $W_s$. These wider peripheral keys are often referred to as "multi-wide" keys. It is desirable to make one or more of these multi-wide keys conductive because they are frequently used, with spacebar key 22 and/or enter key 24 being most preferred.

The specific construction of a conductive key is described in more detail with reference to FIGS. 2–6. FIGS. 2 and 3 illustrate spacebar key 22 operatively mounted to a portion of housing 12 which includes a rigid plastic or metal mounting plate 36, a dome sheet 38, and a rigid backing plate 40 of plastic or metal construction. Spacebar key 22 is illustrated and used throughout the remaining portion of this description as an exemplary conductive key constructed according to this invention.

Spacebar key 22 includes a key body 42 which is mounted to mounting plate 36 and guided by central plunger 44. Key body 42 is moveable between an extended, ready position (FIG. 2) and a depressed, activated position (FIG. 3). Spacebar key 22 overlies associated computer switching devices, such as contacts, capacitative elements, etc., that are activated in response to depression of key body 42. A keyboard switching device is aligned under each plunger 44 (and other keys of keyboard 10) within a membrane switch array assembly 46, which may comprise a printed circuit board, a resilient mylar sheet with a pattern of conductive traces deposited thereon, or other circuit means. Switch assembly 46 is coupled to other circuitry (such as a microprocessor or buffer) which interfaces with the computer terminal. Mounting plate 36, dome sheet 38, backing plate 40, and switch assembly 46 extend throughout keyboard 10 beneath the keys.

Dome sheet 38 is formed of an elastomer material and includes a plurality of yieldable domes that protrude upwardly from sheet 38. These domes are aligned individually with respective keys in keyboard 10 and provide a resilient spring normally urging or biasing the conductive and non-conductive keys to their extended ready positions. Dome sheet 38 includes dome 48 positioned beneath plunger 44 to upwardly bias key body 42. Dome 48 also provides a contacting actuator for engaging a switch contact provided in switch assembly 46. Dome 48 provides controlled resistance to manual depression of key body 42 to provide the desired "touch" or "feel" to spacebar key 22 as it is depressed by a keyboard user.

Spacebar key 22 further includes a transverse leveling bar 50 which maintains key body 42 in a substantially level orientation regardless of where the user physically pushes key body 42 during its operation. Leveling bar 50 is preferably a bent rod or wire which is movably connected to mounting plate 36 by protruding bearing hooks 52. An open slot defined by hooks 52 permits both translational and pivotal movement of leveling bar 50. Other specific features of a spacebar key are described in U.S. Pat. No. 5,117,076, assigned to Key Tronic Corporation, which is incorporated herein by reference.

Key body 42 is preferably formed of a molded plastic, such as ABS or styrene, which defines an upper contact surface 54. Key body 42 also has conductive material filler embedded in the plastic to provide the desired "conductiveness" of spacebar key 22. The conductive material is preferably stainless steel or aluminum fibers because such material has little or no effect on the color of the resulting conductive key. Other conductive materials, such as carbon or graphite, may also be used.

Spacebar key 22 includes conductive contact plugs 56 and 58 transversely mounted to key body 42 as a vertical downward extension toward switch assembly 46. Plugs 56 and 58 are formed of a soft conductive material and are mounted in key body 42 in electrical coupling relationship with conductive key body 42. Plugs 56 and 58 are preferably formed of a conductive thermoplastic elastomer. Alternatively, the plugs may be formed of a rubber and impregnated with conductive material, such as carbon or graphite.

When key body 42 is depressed to its activated position shown in FIG. 3, plugs 56 and 58 extend through apertures in mounting plate 36 and dome sheet 38 to engage a conductive electrostatic discharge pad 62 (discussed below in more detail) provided on switch assembly 46. Plugs 56 and 58 are soft and resilient to provide desired overtravel after plugs 56 and 58 make electrical contact with key pad 62 during depression of key body 42. Plug overtravel is illustrated in FIG. 4 wherein conductive plug 58 has "bulging" sides 60 near the point of contact with switch assembly 46.

FIG. 5 diagrammatically illustrates an electrostatic discharge pad 62 which is positioned on switch assembly 46 beneath each of the conductive plugs 56 and 58. Electrostatic discharge pad 62 is coupled to ground 64 through a path resistor 66. Pad 62 is illustrated as circular, but may have other geometric shapes. Plugs 56 and 58 establish electrical switch contact with electrostatic discharge pad 62 when key body 42 is depressed forming a switch "S" shown in FIG. 6.

In operation, conductive spacebar key 22 is biased by dome 48 to an extended ready position illustrated in FIG. 2. Plugs 56 and 58 are suspended above electrostatic discharge pad 62 on switch assembly 46 and are not in electrical contact with these pads. When a user depresses key body 42 to an activated position shown in FIG. 3, plugs 56 and 58 electrically contact respective electrostatic discharge pads 62 provided on switch assembly 46. Any accumulated electrostatic charge on the user is dissipated to ground through an electrical path which includes: conductive key body 42 (or more particularly, the conductive stainless steel fibers embedded therein), plugs 56 and 58, electrostatic discharge pad 62, and path resistor 66. Plugs 56 and 58, pad 62, path resistor 66, and ground 64 therefore provide an electrostatic discharge means for dissipating electrostatic charge accumulated on a user through key body 42 upon operation of conductive spacebar key 22. Accordingly, through normal operation of spacebar key 22, electrostatic charge is routinely dissipated to ground, thereby reducing potential health risks associated with operating computers.

FIG. 6 is a circuit representation of a conductive key produced in accordance with this invention. Node 68 represents contact surface 54 of spacebar key 22 which is touched by the user during normal operation. Two resistors $R_{kb}$ and $R_p$ are serially connected between node 68 and switch contacts 56, 58 of switch S. Resistor $R_{kb}$ represents the resistance of key body 42 and resistor $R_p$ represents the resistance of plugs 56 and 58. A third resistor $R_{pr}$ is connected between a switch pad 62 of switch S and ground 64 to represent the resistance of path resistor 66 (FIG. 5). Switch S is open when spacebar key 22 is in the ready position and plugs 56 and 58 are spaced from pad 62 and switch S is closed when spacebar key 22 is in the activated position and plugs 56 and 58 engage pad 62.

In the preferred embodiment, electrical resistance $R_{kb}$ of key body 42 is approximately one megohm or less and at least one of the other resistances (i.e., resistance $R_p$ of plugs 56 and 58 or resistance $R_{pr}$ of path resistor 66) is greater than resistance $R_{kb}$ of key body 42. Preferably, either resistances $R_p$ and $R_{pr}$ is substantially greater than key body resistance $R_{kb}$. Plug resistance $R_p$ and/or path resistance $R_{pr}$ is preferably from approximately 10 to 500 megohms. More preferably, at least one of resistances $R_p$ and $R_{pr}$ is from approximately 10 to 500 megohms, with a range of approximately 200 to 300 megohms being most preferred. It is desirable that at least one of the resistances $R_p$ and $R_{pr}$ be greater than resistance $R_{kb}$ to prevent the user from being shocked upon touching and operating key body 42.

This invention provides an effective means for progressively dissipating electrostatic charge which accumulates on a computer user. By incorporating a frequently used electrically conductive key into a computer keyboard, electrostatic charge is routinely dissipated from the user during natural keyboard operation. There are no special pads or devices to contact prior to using the keyboard. Additionally, the present invention provides a reliable dissipating means without risk of electric shock. The preferred embodiment has been described with reference to computer keyboards, but this invention may be adapted for other types of keyboards.

In compliance with the statute, the invention has been described in language more or less specific as to structural and methodical features. It is to be understood, however, that the invention is not limited to the specific features described or shown, since the means herein disclosed comprise preferred forms of putting the invention into effect. The invention is therefore claimed in any of its forms or modifications within the proper scope of the appended claims appropriately interpreted in accordance with the doctrine of equivalents.

We claim:

1. A computer keyboard comprising:

a housing;

multiple non-conductive keys operatively mounted in the housing, individual non-conductive keys having a non-conductive key body which is movable between an extended ready position and a depressed activated position and means for biasing the non-conductive key body to the ready position;

at least one conductive key operatively mounted in the housing, the conductive key including a conductive key body which is movable between an extended ready position and a depressed activated position and means for biasing the conductive key body to the ready position;

a switch assembly mounted in the housing beneath the nonconductive and conductive keys, the switch assembly having contacts for engagement by corresponding ones of the non-conductive and conductive keys when individual non-conductive and conductive key bodies are depressed to their activated positions;

a conductive plug electrically coupled and mounted to the conductive key body of the conductive key for engaging an electrostatic discharge pad coupled to ground when the conductive key body is depressed, the plug having a resistance from approximately 10 to 500 megohms; and the keyboard being configured to dissipate electrostatic charge from a keyboard user to ground through the conductive key body, the plug, and the electrostatic discharge pad when the conductive key body is depressed.

2. A keyboard according to claim 1 wherein the plug is formed of a conductive thermoplastic elastomer.

3. A keyboard according to claim 1 wherein the plug is formed of an elastomer and impregnated with a conductive material.

4. A keyboard according to claim 1 wherein the plug has a resistance from approximately 200 to 300 megohms.

5. A keyboard according to claim 1 wherein the conductive key body is formed of molded plastic embedded with conductive material.

6. A keyboard according to claim 1 further comprising multiple non-conductive keys and at least one conductive key arranged in a selected pattern in the housing, individual multiple non-conductive keys having a first width, and the conductive key having a second width greater than the first width.

7. A keyboard according to claim 1 wherein the keyboard has "alphanumeric" keys, "function" keys, a "spacebar" key, and an "enter" key, and wherein the non-conductive keys are selected from the "alphanumeric" keys and the "function" keys, and wherein the conductive key is selected from one of the "spacebar" key and the "enter" key.

8. A keyboard according to claim 1 wherein:

the conductive key body is formed of molded plastic embedded with a conductive material; and the plug is formed of a conductive thermoplastic elastomer, the conductive material in the key body conducting electrostatic charge to the plug.

9. A keyboard according to claim 1 wherein the conductive key body has a resistance of less than one megohm.

10. A keyboard according to claim 1 wherein:

the switch assembly further comprises a path resistor coupled between the electrostatic discharge pad and ground;

the conductive key body has a resistance of less than one megohm; and at least one of the plug and the path resistor has a resistance from approximately 10 to 500 megohms.

11. A key for a computer keyboard, comprising:

a conductive key body movable between an extended ready position and a depressed activated position, the key body having a resistance of less than one megohm;

means for biasing the key body in the ready position;

a conductive plug electrically coupled and mounted to the conductive key body, the plug having a resistance from approximately 10 to 500 megohms;

an electrostatic discharge pad positioned adjacent the conductive plug, the plug electrically engaging the discharge pad when the key body is depressed to the activated position; and a path resistor coupled between the discharge pad and ground.

12. A key for a computer keyboard according to claim 11 wherein the key body comprises a molded plastic embedded with conductive material.

13. A key for a computer keyboard according to claim 11 wherein the resistance of the path resistor is from approximately 10 to 500 megohms.

14. A computer keyboard comprising:

a housing;

multiple non-conductive keys operatively mounted in the housing, individual non-conductive keys having a non-conductive key body which is movable between an extended ready position and a depressed activated position and means for biasing the non-conductive key body to the ready position;

at least one conductive key operatively mounted in the housing, the conductive key including a conductive key body which is movable between an extended ready position and a depressed activated position and means for biasing the conductive key body to the ready position;

a switch assembly mounted in the housing beneath the non-conductive and conductive keys, the switch assembly having contacts for engagement by corresponding ones of the non-conductive and conductive keys when individual non-conductive and conductive key bodies are depressed to their activated positions, the switch assembly having an electrostatic discharge pad provided thereon which is coupled to ground;

a conductive plug having one end electrically coupled and mounted to the conductive key body of the conductive key and the other end adjacent to, but spaced from, the electrostatic discharge pad, the other end of the conductive plug engaging the electrostatic discharge pad when the conductive key body is depressed; and the keyboard being configured to dissipate electrostatic charge from a keyboard user to ground through the conductive key body, the plug, and the electrostatic discharge pad when the conductive key body is depressed.

15. A keyboard according to claim 14 wherein the plug is formed of a conductive thermoplastic elastomer.

16. A keyboard according to claim 14 wherein the plug is formed of an elastomer and impregnated with a conductive material.

17. A keyboard according to claim 14 wherein the plug has a resistance from approximately 10 to 500 megohms.

18. A keyboard according to claim 14 wherein the plug has a resistance from approximately 200 to 300 megohms.

19. A keyboard according to claim 14 wherein the conductive key body is formed of molded plastic embedded with conductive material.

20. A keyboard according to claim 14 further comprising multiple non-conductive keys and at least one conductive key arranged in a selected pattern in the housing, individual multiple non-conductive keys having a first width, and the conductive key having a second width greater than the first width.

21. A keyboard according to claim 14 wherein the keyboard has "alphanumeric" keys, "function" keys, a "spacebar" key, and an "enter" key, and wherein the non-conductive keys are selected from the "alphanumeric" keys and the "function" keys, and wherein the conductive key is selected from one of the "spacebar" key and the "enter" key.

22. A keyboard according to claim 14 wherein:

the conductive key body is formed of molded plastic embedded with a conductive material; and the plug is formed of a conductive thermoplastic elastomer, the conductive material in the key body conducting electrostatic charge to the plug.

23. A keyboard according to claim 14 wherein the conductive key body has a resistance of less than one megohm and the plug has a resistance from approximately 10 to 500 megohms.

24. A keyboard according to claim 14 wherein:

the switch assembly further comprises a path resistor coupled between the electrostatic discharge pad and ground;

the conductive key body has a resistance of less than one megohm; and at least one of the plug and the path resistor has a resistance from approximately 10 to 500 megohms.

* * * * *